US009685720B1

(12) United States Patent
Wang et al.

(10) Patent No.: US 9,685,720 B1
(45) Date of Patent: Jun. 20, 2017

(54) CONNECTOR STRUCTURE FOR FLEXIBLE LIGHT STRIP

(71) Applicant: Amphenol LTW Technology Co., Ltd., New Taipei (TW)

(72) Inventors: Jun Wang, New Taipei (TW); Chih-Wen Hu, New Taipei (TW); Jen-Yuan Hung, New Taipei (TW)

(73) Assignee: AMPHENOL LTW TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/152,896

(22) Filed: May 12, 2016

(30) Foreign Application Priority Data

Apr. 8, 2016 (TW) ..... 105111117 A

(51) Int. Cl.

| | |
|---|---|
| ***H01R 4/24*** | (2006.01) |
| ***H01R 12/61*** | (2011.01) |
| ***H01R 13/629*** | (2006.01) |
| ***H01R 13/52*** | (2006.01) |
| ***F21S 4/26*** | (2016.01) |
| ***F21V 23/06*** | (2006.01) |
| *F21Y 101/02* | (2006.01) |
| *F21Y 103/00* | (2016.01) |

(52) U.S. Cl.
CPC ..... *H01R 12/616* (2013.01); *F21S 4/26* (2016.01); *F21V 23/06* (2013.01); *H01R 4/24* (2013.01); *H01R 13/5202* (2013.01); *H01R 13/5205* (2013.01); *H01R 13/62966* (2013.01); *F21Y 2101/02* (2013.01); *F21Y 2103/003* (2013.01)

(58) Field of Classification Search
CPC ..... H01R 4/5033
USPC ..... 439/427, 428, 429
See application file for complete search history.

(56) References Cited

U.S. PATENT DOCUMENTS 3,411,129 A * 11/1968 Peters ..... H01R 4/5033 174/84 R
6,739,899 B2 * 5/2004 Kuwayama ..... H01R 4/188 439/427

FOREIGN PATENT DOCUMENTS

| | | |
|---|---|---|
| TW | M430055 U | 5/2012 |
| TW | M432161 U | 6/2012 |
| TW | M502181 U | 6/2015 |
| TW | M516249 U | 1/2016 |

(Continued)

OTHER PUBLICATIONS

Office Action dated Feb. 23, 2017 of the corresponding Taiwan patent application.

*Primary Examiner* — Phuong Dinh
(74) *Attorney, Agent, or Firm* — Chun-Ming Shih; HDLS IPR Services

(57) ABSTRACT

A connector structure (100) for a flexible light strip (10) includes a cable joint (110) and an insulation body (200). The cable joint (110) includes a housing (120) and a plurality of conductive terminals (130) assembled in the housing (120). Each of the conductive terminals (130) includes a piercing portion (150). The insulation body (200) has a first end (210) and a second end (220) communicating with the first end (210). The flexible light strip (10) is inserted into the first end (210), and the housing (120) is inserted into the second end (220). The piercing portion (150) is parallel to the flexible light strip (10) and correspondingly pierces the flexible light trip (10) to be electrically coupled to the same. Therefore, the connector structure (100) achieves fast assembly and improves efficiency and reliability for connection.

14 Claims, 7 Drawing Sheets

(56) References Cited

FOREIGN PATENT DOCUMENTS

TW M524581 U 6/2016

* cited by examiner

CONNECTOR STRUCTURE FOR FLEXIBLE LIGHT STRIP

TECHNICAL FIELD

The present invention relates to a connector assembly and, in particular, to a connector structure for a flexible light strip, wherein the connector structure is used to be electrically coupled to the flexible light strip.

BACKGROUND

There is a silicone waterproof sealing member in the market, which is used to assemble a light emitting diode (LED) on a band-shaped flexible printed circuit (FPC) board to form a LED strip/bar. The LED strip/bar has a lifespan of 80,000 to 100,000 hours, which is environmentally friendly, and the sealing member can be cut into a desired shape and extend as desired, so the LED strip/bar is gradually used in various environments for lighting.

The conventional LED strips/bars are usually connected by manual soldering, and then the LED strips/bars are sealed by silicone or other materials after soldering processes. In the manual soldering process, there are quite some difficulties to deal with. For example, silicone of the sealing member has to be removed first before carrying out the soldering process, and consequently, installation is time-consuming, and the connection quality is not reliable due to unstable soldering quality. Thus, the connection method has inferior sealing and allows low current only, so it is not suitable for used in environments in need of effective sealing. Furthermore, soldering connection is disadvantageous for maintenance, so it wastes considerable cost and time for maintenance.

Accordingly, the inventor made various studies to solve the above-mentioned defects, on the basis of which the present invention is accomplished.

SUMMARY

It is an object of the present invention to provide a connector structure for a flexible light strip, whereby quick assembly can be achieved, connection can be made efficiently, and reliability and quality of connection can be enhanced.

Accordingly, the present invention provides a connector structure for a flexible light strip, comprising a cable joint and an insulation body. The cable joint includes a housing and a plurality of conductive terminals assembled in the housing, wherein each conductive terminal includes at least one piercing portion. The insulation body includes a first end and a second end communicating with the first end. The flexible light strip is inserted into the first end, and the housing is inserted into the second end, wherein the at least one piercing portion is parallel to the flexible light strip and correspondingly pierces the flexible light strip to be electrically coupled to the flexible light strip.

The present invention further provides the following effects. It is very easy and quick to install the connector structure of the present invention. Each conductive terminal having the piercing portion can parallelly and directly pierce the flexible light strip, thereby preventing the defects resulting from using conventional soldering methods. Furthermore, since the present invention has the advantage of quick installation with ease and convenience, it is also advantageous for a user to repair or replace the flexible light strip.

Furthermore, the connector structure of the present invention utilizes a first cover and a second cover which are rotatable to clamp and position the flexible light strip, thereby enhancing reliability and quality of connection. The connector structure utilizes a waterproof member and a waterproof ring to effectively prevent entry of moisture and impurities, thus enhancing sealing, waterproof and dust-proof effect and prolonging a lifespan of the flexible light strip.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
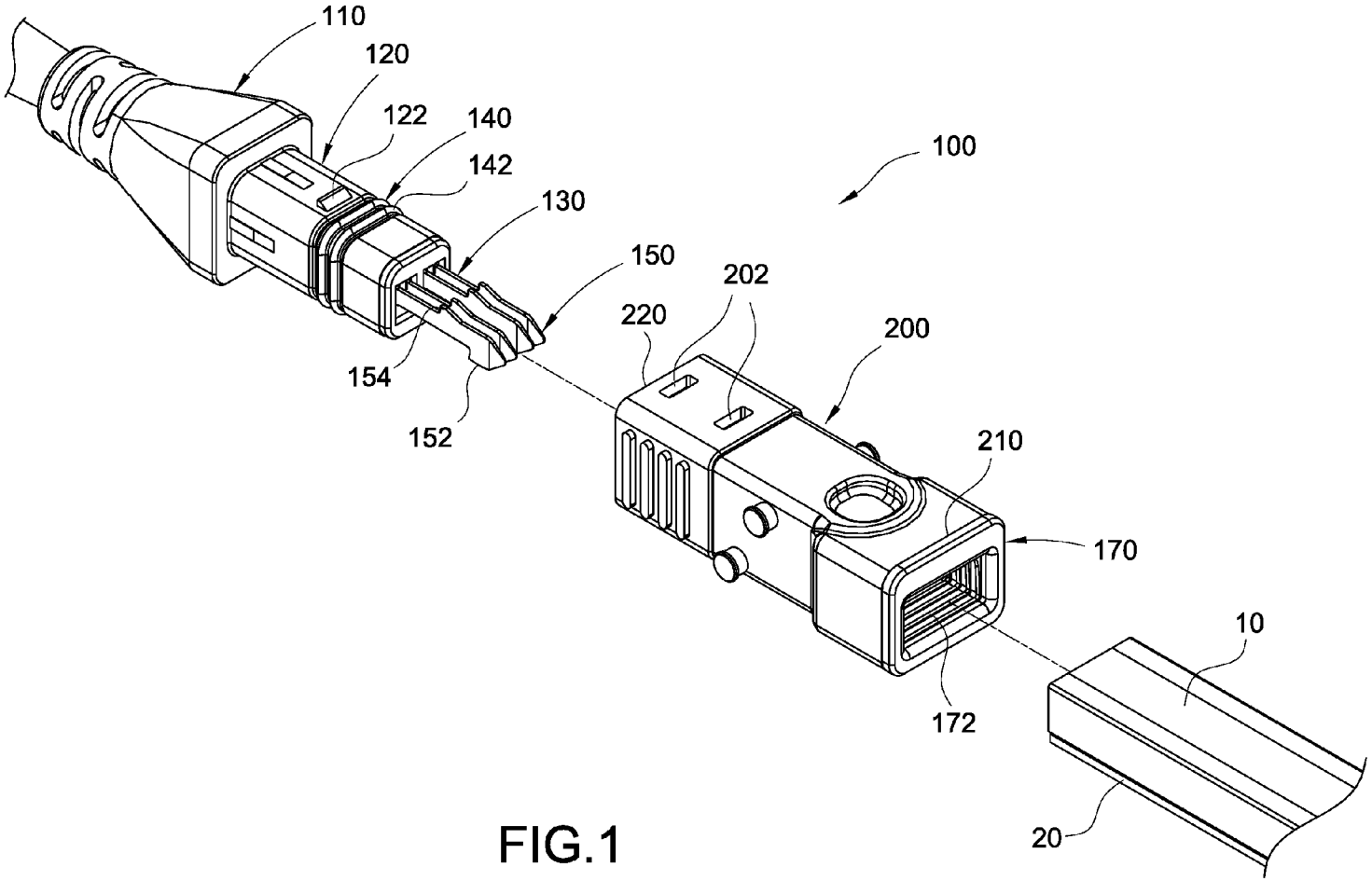
FIG. 1 is a separated view illustrating a connector structure for a flexible light strip according to a first embodiment of the present invention.
Figure 2:
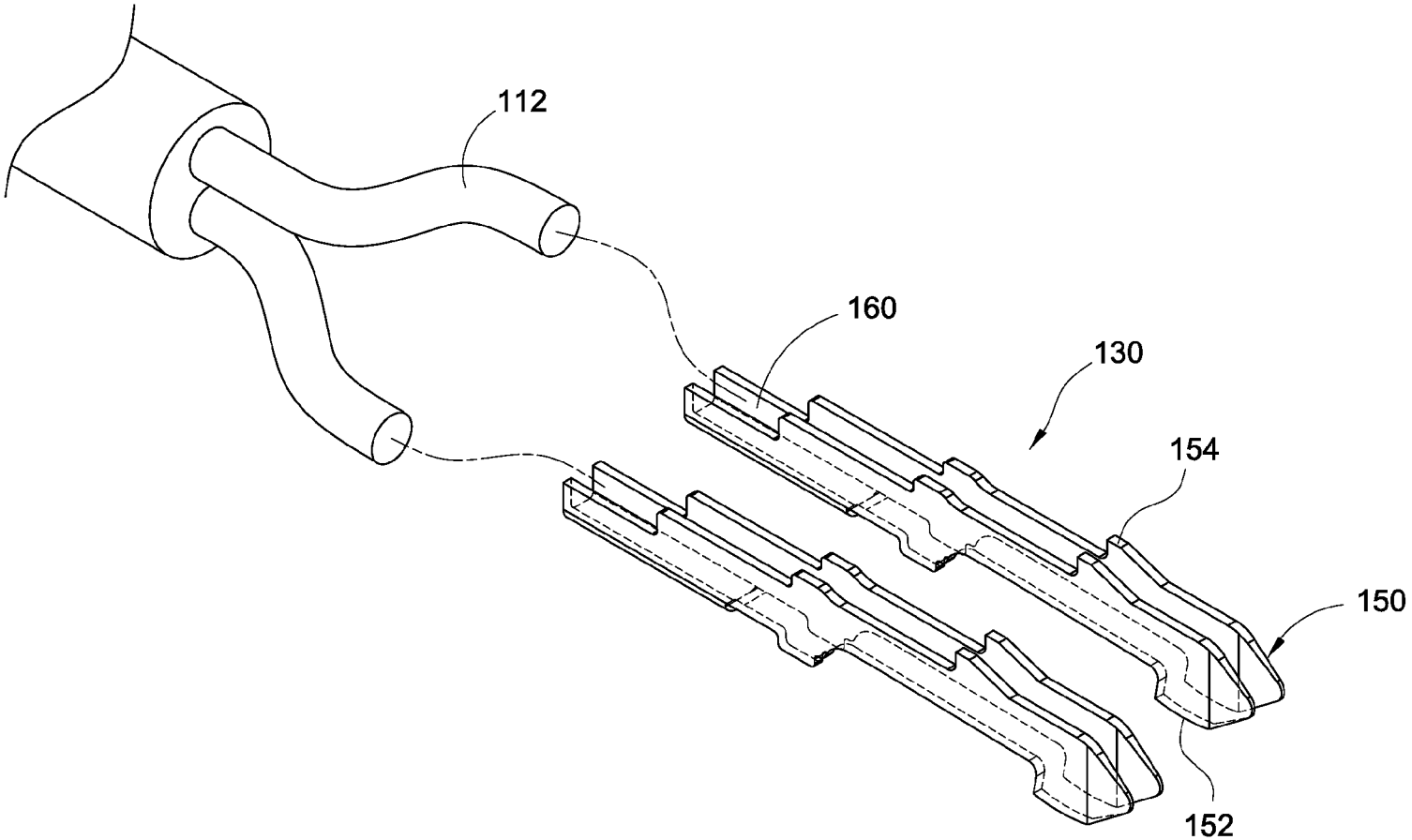
FIG. 2 is an exploded view of the present invention, illustrating a cable core and a conductive terminal.

As shown in FIGS. 1 and 2, the present invention provides a connector structure 100 for a flexible light strip 10. The connector structure 100 comprises a cable joint 110 and an insulation body 200. The flexible light strip 10 is preferably a light-emitting-diode (LED) light bar or an LED light strip consisting of a flexible printed circuit (FPC) board/flexible flat cable (FFC) 20 and a plurality of LEDs (not illustrated).

Figure 4:
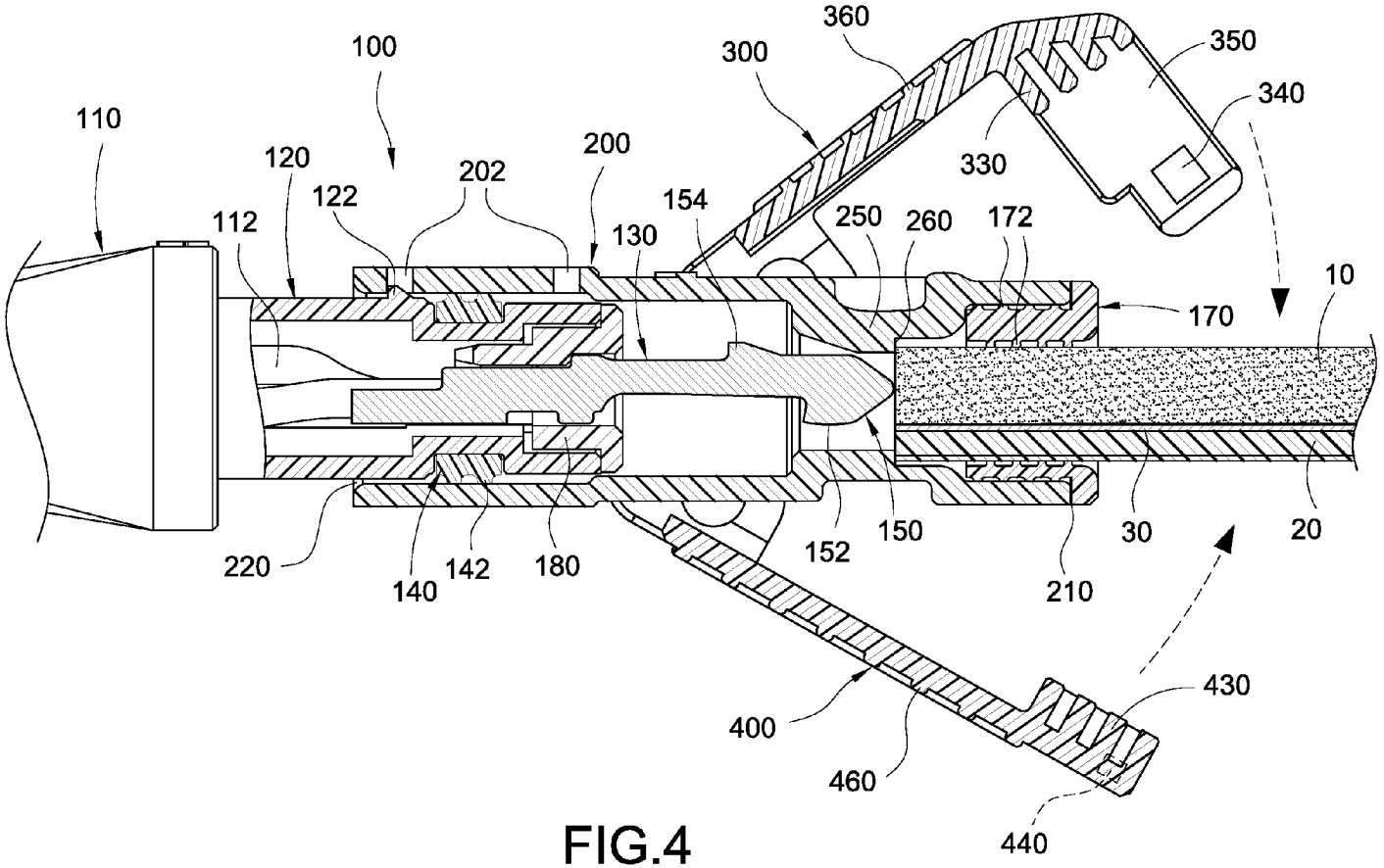
FIG. 4 is a cross-sectional view illustrating a first movement according to the second embodiment of the present invention.

As shown in FIG. 4, the circuit board 20 is preferably attached to one side of the flexible light strip 10, and a conductive pad 30 electrically coupled to each LED (not illustrated) is disposed on one side of the circuit board 20. The rest space in the flexible light strip 10 contains silicone and/or other materials such as plastic, so as to form an LED light strip, an LED light band or other related product which can be cut, bent, or assembled as desired.

According to a first embodiment shown in FIG. 1, the cable joint 110 includes a housing 120 and a plurality of conductive terminals 130 assembled in the housing 120. Each of the conductive terminals 130 includes a piercing portion 150. The insulation body 200 includes a first end 210 and a second end 220 communicating with the first end 210, the flexible light strip 10 is inserted into the first end 210, and the housing 120 is inserted into the second end 220, wherein the at least one piercing portion 150 is parallel to the flexible light strip 10 and correspondingly pierces the flexible light strip 10 to be electrically coupled to the flexible light strip 10.

In the embodiment shown in FIG. 2, the cable joint 110 includes a plurality of cable cores 112 connected to the conductive terminals 130, each of the conductive terminals 130 includes an accommodating container 160 containing each of the cable cores 112, the accommodating container 160 is disposed at one end opposite to the at least one piercing portion 150. Each of the conductive terminals 130 includes two piercing portions 150, two planar portions 152 and two positioning portions 154, each of the planar portions 152 is disposed at one side of each of the piercing portions 150, and each of the positioning portions 154 is disposed at the other side of each of the piercing portions 150.

For simplicity and for the purpose of describing the present embodiment, two cable cores 112 and two conductive terminals 130 are described herein as an example. The number of the cable cores 112 and the number of the conductive terminals 130 may vary as required, and the present invention is not limited in this regard. However, in other different embodiment, the cable joint 110 can also use a connector (not illustrated) to directly connect the conductive terminal 130; configurations may vary as required.

Referring to FIG. 4, the housing 120 further includes a positioning plug 180 to position each of the conductive terminals 130, whereby each of the conductive terminals 130 is fixed at one end of the housing 120 of the cable joint 110, wherein the two piercing portions 150 are preferably disposed at a tip of each of the conductive terminals 130. Furthermore, the insulation body 200 further includes two concaved portions 250 having a stop portion 260, the two corresponding concaved portions 250 protrudes inwardly of the insulation body 200, and the stop portion 260 is provided to position the positioning portions 154 or make contact with the flexible light strip 10.

After the positioning plug 180 is engaged with each of the conductive terminals 130, the positioning plug 180 engaged with the conductive terminals 130 is assembled at an end portion of the housing 120, wherein the piercing portion 150 preferably protrudes out of the housing 120. When the flexible light strip 10 is inserted into the first end 210 and is in contact with the stop portion 260, the user inserts the cable joint 110 in a direction toward the first end 210, the conductive terminal 130 of the housing 120 is parallel to the flexible light strip 10 and correspondingly pierces the flexible light strip 10, so that the planar portion 152 can be electrically coupled to the conductive pad 30 of the flexible light strip 10, and thereby electrical power can be delivered to the conductive pad 30 to make each LED (not illustrated) light up.

Furthermore, each conductive terminal 130 is inserted into the flexible light strip 10 along a direction perpendicular to the conductive pad 30 disposed on the flexible light strip 10. An outer side surface of the insulation body 200 includes a plurality of protrusions 270, and each of the protrusions 270 is disposed close to the second end 220 of the insulation body 200, thereby facilitating the user's holding the insulation body 200 for insertion of the flexible light strip 10.

Figure 3:
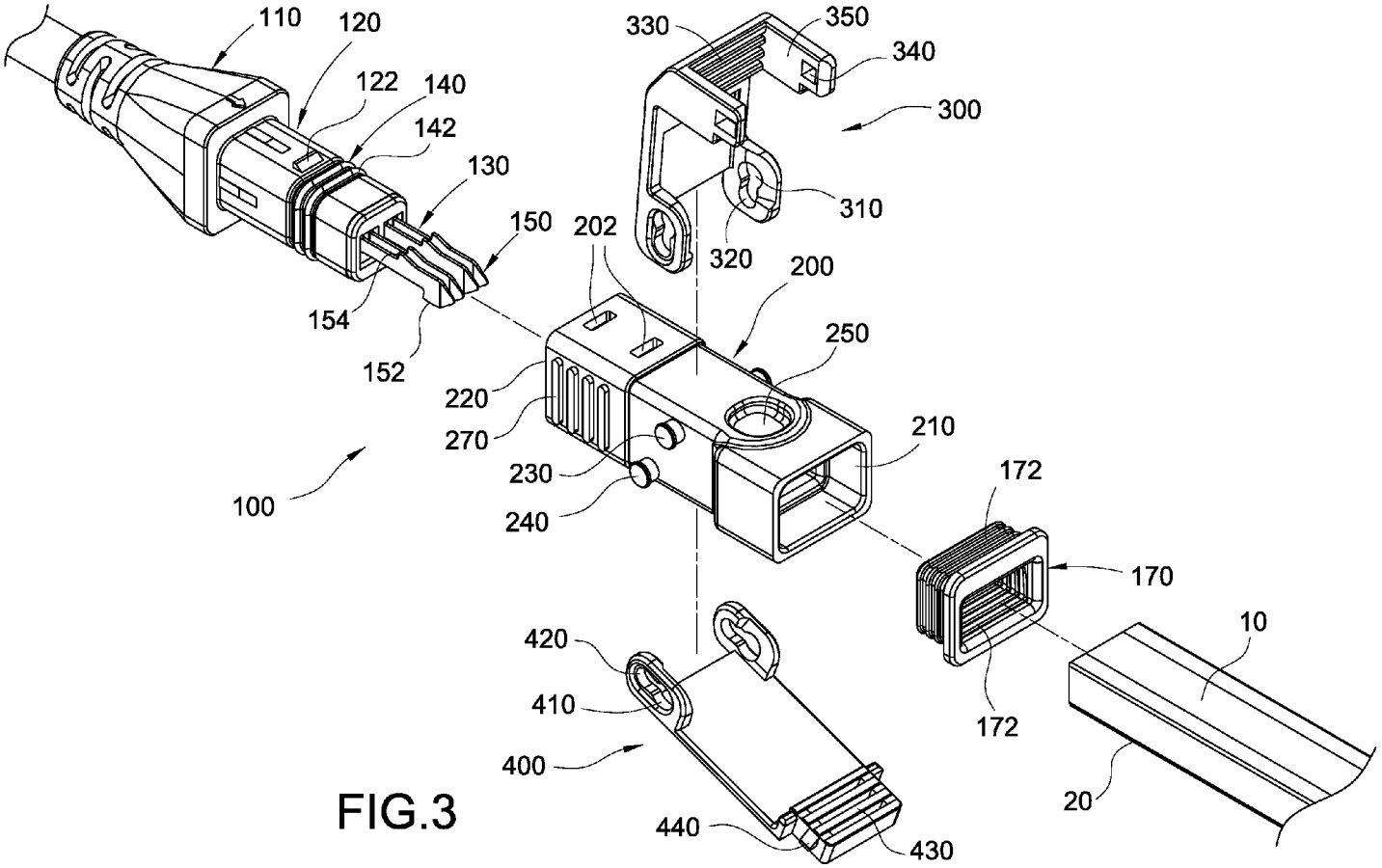
FIG. 3 is an exploded view according to a second embodiment of the present invention.

The first embodiment further includes a waterproof member 170 and a waterproof ring 140. The waterproof member 170 receives the flexible light strip 10 and is correspondingly assembled at the first end 210, and the waterproof ring 140 surrounds an outer circumferential surface of the housing 120 and is correspondingly assembled at the second end 220. As shown in FIGS. 3 and 4, the waterproof member 170 further includes a plurality of waterproof ribs 172, and the waterproof ribs 172 are disposed on an exterior sidewall surface and an interior sidewall surface of the waterproof member 170. A plurality of the waterproof ribs 172 is also disposed on an exterior surface of the waterproof ring 140. Therefore, the waterproof member 170 and the waterproof ring 140 can prevent entry of moisture, dust, or impurities into the connector structure 100. According, the present embodiment provides effective sealing for waterproof or dustproof, and a lifespan is prolonged.

As shown in FIG. 3, the second embodiment further includes a first cover 300 and a second cover 400 clamping the flexible light strip 10, and the insulation body 200 further includes a first pivot pair 230 pivotally connected to the first cover 300 and a second pivot pair 240 pivotally connected to the second cover 400.

Figure 7:
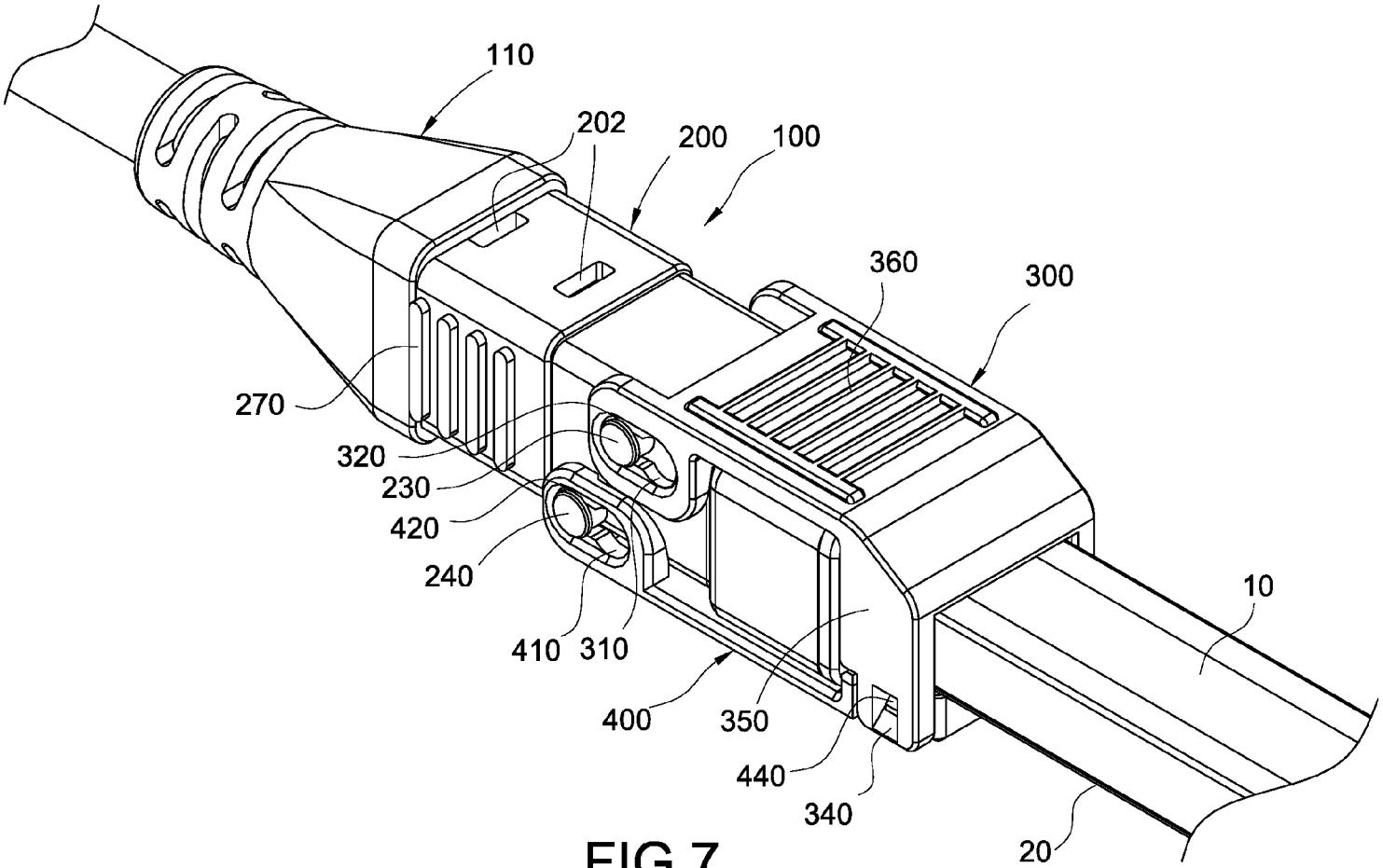
FIG. 7 is a perspective view illustrating that the connector structure for the flexible light strip is engaged with flexible light strip.

The first cover 300 includes a first assembly hole 310 and a first pivot hole 320 communicating with the first assembly hole 310, and the second cover 400 includes a second assembly hole 410 and a second pivot hole 420 communicating with the second assembly hole 410. As shown in FIG. 7, a diameter of the first pivot hole 320 is smaller than a diameter of the first assembly hole 310, and a diameter of the second pivot hole 420 is smaller than a diameter of the second assembly hole 410.

When to assemble the first cover 300 to the first pivot pair 230, the first pivot pair 230 is first inserted into the first assembly hole 310 and then transversely moves to be received in the first pivot hole 320 to accomplish assembly of the first cover 300. Similarly, when to assemble the second cover 400 to the second pivot pair 240, the second pivot pair 240 is first inserted into the second assembly hole 410 and then transversely moves to be received in the second pivot hole 420 to accomplish assembly of the second cover 400. Therefore, it is easy and convenient to assemble the first cover 300 and the second cover 400 to the insulation body 200.

The first cover 300 further includes a plurality of first non-slip portions 330 and two fasteners 340, the second cover 400 includes a plurality of second non-slip portions 430 and two engagement portions 440, and the two engagement portions 440 are engaged with the two fasteners 340, so that the first cover 300 covers with respect to the second cover 400 to clamp the flexible light strip 10, and thereby the flexible light strip 10 can be stably positioned in the insulation body 200.

Figure 5:
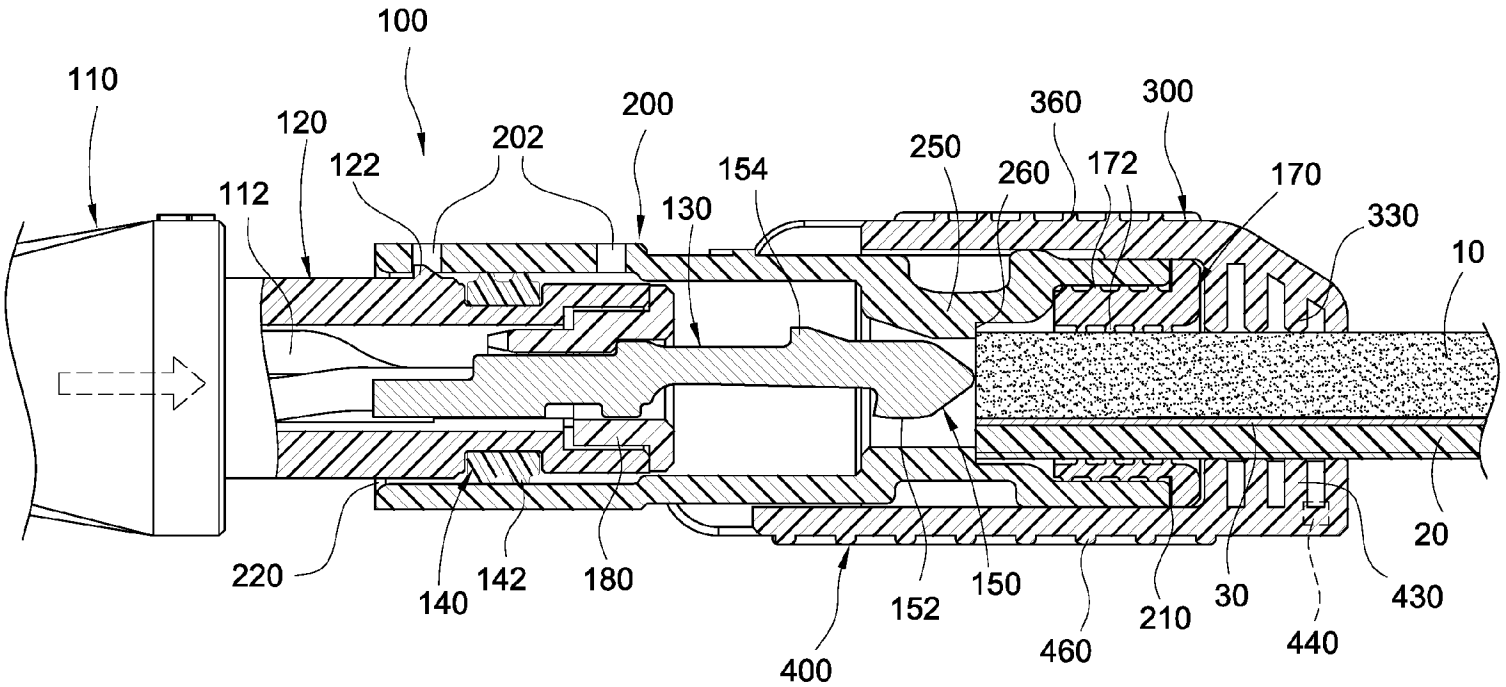
FIG. 5 is a cross-sectional view illustrating a second movement according to the second embodiment of the present invention.

Referring to FIGS. 5 and 7, the first non-slip portions 330 and the second non-slip portions 430 are preferably waterproof ribs or other similar ribs made of plastic. In the present embodiment, the first non-slip portions 330 and the second non-slip portions 430 not only prevent the flexible light strip 10 from being separated/falling off from the first end 210 of the insulation body 200, but also provide water-proof and dust-proof effect.

When the first non-slip portions 330 and the second non-slip portions 430 rotate to clamp the flexible light strip 10, they also contact and position the waterproof member 170, so that the insulation body 200 is double sealed at the first end 210. Furthermore, the first cover 300 includes two extension arms 350 perpendicularly protruding from the first cover 300, and the two fasteners 340 are disposed on the two extension arms 350 respectively. It should be noted that, in the present embodiment, the fastener 340 is disposed on the extension arm 350 of the first cover 300, and the engagement portion 440 is disposed on the second cover 400; however, in different embodiments, the fastener 340 and the engagement portion 440 can be interchanged to be disposed on the second cover 400 and the first cover 300 respectively, and the present invention is not limited in this regard.

In the present embodiment, the housing 120 further includes at least one bump 122, the insulation body 200 includes two positioning holes 202 corresponding to the at least one bump 122, so that the cable joint 110 can be stably inserted in the second end 220 of the insulation body 200. Furthermore, an outer surface of the first cover 300 includes a plurality of first embossed portions 360, and an outer surface of the second cover 400 includes a plurality of second embossed portions 460, so as to provide a non-slippery feature to help better holding.

Operation steps of the connector structure 100 are hereinafter described in brief. As shown in FIG. 4, the flexible light strip 10 received in the waterproof member 170 is inserted into the first end 210 of the insulation body 200, so that the waterproof member 170 is positioned at one side of the concaved portion 250 in a contact manner, and the flexible light strip 10 makes contact with the stop portion 260. In order to enhance the effect of positioning the flexible light strip 10, the first cover 300 and the second cover 400 are rotatable to clamp the flexible light strip 10, so as to make the first non-slip portions 330 and the second non-slip portions 440 clamp two sides of the flexible light strip 10 respectively, as shown in FIG. 5.

Figure 6:
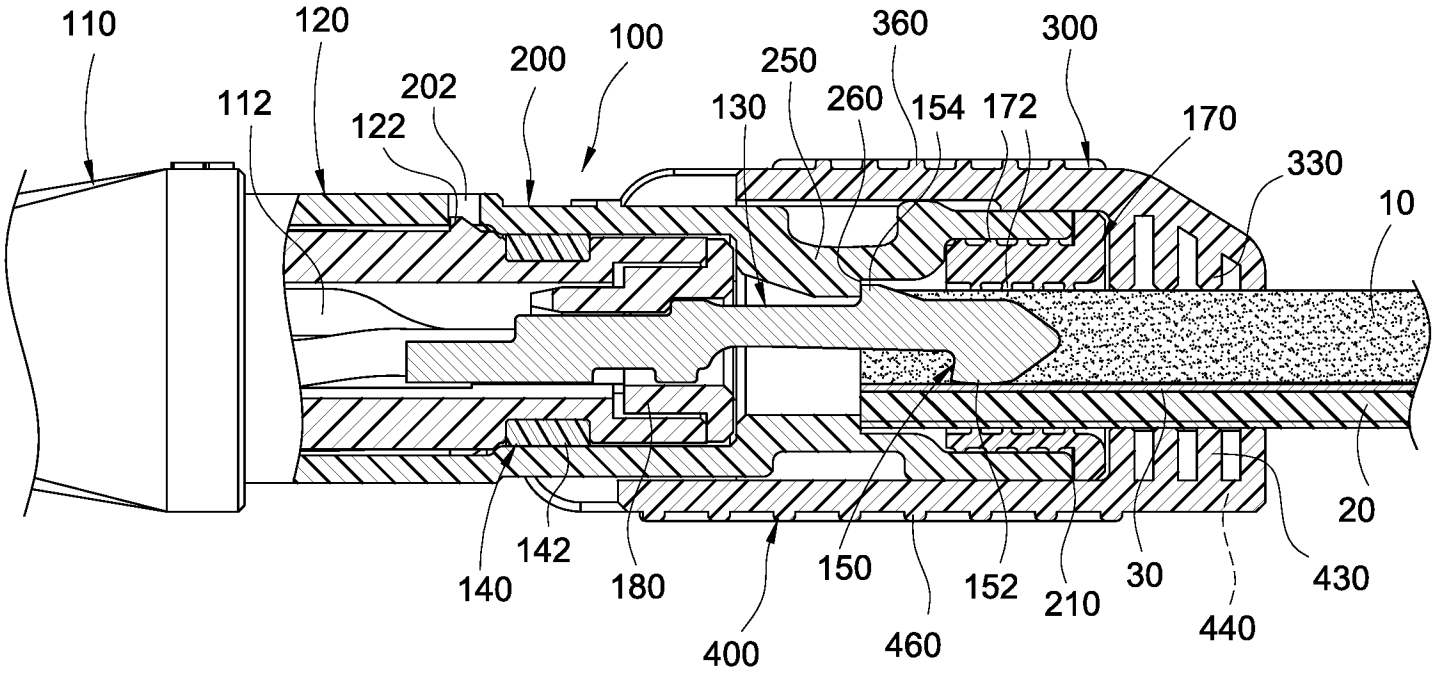
FIG. 6 is a cross-sectional view illustrating a third movement according to the second embodiment of the present invention.

As shown in FIGS. 6 and 7, the conductive terminals 130 assembled in the housing 120 are inserted in the second end 220 of the insulation body 200. When a user inserts the cable joint 110 in a direction toward the first end 210, the piercing portion 150 of each conductive terminal 130 is parallel to the flexible light strip 10 and correspondingly pierces the same, so that the planar portion 152 can be electrically coupled to the conductive pad 30. At this point, the bump 122 of the housing 120 is engaged with the positioning hole 202 from an outer side to an inner side of the same. Accordingly, installation of the flexible light strip 10 can be accomplished quickly.

The connector structure 100 of the present invention utilizes each conductive terminal 130 having the piercing portion 150 to parallelly and directly pierce the flexible light strip 10, so as to achieve connection effectively. Furthermore, the connector structure 100 utilizes the first cover 300 and the second cover 400 which are rotatable to clamp and position the flexible light strip 10, thereby enhancing reliability and quality of the connection. The connector structure 100 also utilizes the waterproof member 170 and the waterproof ring 140 to effectively prevent entry of moisture and impurities, so that the present invention can provide good sealing, waterproof and dustproof effects, and a lifespan of the flexible light strip 10 can be prolonged.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A connector structure for a flexible light strip (10), comprising:

a cable joint (110) including a housing (120) and a plurality of conductive terminals (130) assembled in the housing (120), each of the conductive terminals (130) including at least one piercing portion (150);

an insulation body (200) including a first end (210) and a second end (220) communicating with the first end (210), the flexible light strip (10) being inserted into the first end (210), and the housing (120) being inserted into the second end (220), wherein the at least one piercing portion (150) is parallel to the flexible light strip (10) and correspondingly pierces the flexible light strip (10) to be electrically coupled to the flexible light strip (10); and a waterproof member (170) and a waterproof ring (140), the waterproof member (170) receiving the flexible light strip (10) and correspondingly assembled at the first end (210), the waterproof ring (140) surroundingly disposed on an outer circumferential surface of the housing (120) and correspondingly assembled at the second end (220).

2. The connector structure for the flexible light strip of claim 1, wherein the waterproof member (170) further includes a plurality of waterproof ribs (172), and the waterproof ribs (172) are disposed on an exterior sidewall surface and an interior sidewall surface of the waterproof member (170).

3. The connector structure for the flexible light strip of claim 1, further comprising a first cover (300) and a second cover (400) clamping the flexible light strip (10), the insulation body (200) further including a first pivot pair (230) pivotally connected to the first cover (300) and a second pivot pair (240) pivotally connected to the second cover (400).

4. The connector structure for the flexible light strip of claim 3, wherein the first cover (300) includes a first assembly hole (310) and a first pivot hole (320) communicating with the first assembly hole (310), and the second cover (400) includes a second assembly hole (410) and a second pivot hole (420) communicating with the second assembly hole (410).

5. The connector structure for the flexible light strip of claim 4, wherein a diameter of the first pivot hole (320) is smaller than a diameter of the first assembly hole (310), and a diameter of the second pivot hole (420) is smaller than a diameter of the second assembly hole (410).

6. The connector structure for the flexible light strip of claim 3, wherein the first cover (300) further includes a plurality of first non-slip portions (330) and two fasteners (340), the second cover (400) includes a plurality of second non-slip portions (430) and two engagement portions (440), and the two engagement portions (440) are engageable with the two fasteners (340).

7. The connector structure for the flexible light strip of claim 6, wherein the first non-slip portions (330) and the second non-slip portions (430) are rotatable to contact the flexible light strip (10), the first cover (300) includes two extension arms (350) disposed protrudingly, and the two fasteners (340) are disposed on the two extension arms (350) respectively.

8. The connector structure for the flexible light strip of claim 3, wherein an outer surface of the first cover (300) includes a plurality of first embossed portions (360), and an outer surface of the second cover (400) includes a plurality of second embossed portions (460).

9. The connector structure for the flexible light strip of claim 1, wherein the at least one piercing portion (150) is disposed at a tip of each of the conductive terminals (130).

10. The connector structure for the flexible light strip of claim 1, wherein the cable joint (110) further includes a plurality of cable cores (112) connected to the conductive terminals (130), each of the conductive terminals (130) includes an accommodating container (160) containing each of the cable cores (112), and the accommodating container (160) is disposed at one end opposite to the at least one piercing portion (150).

11. A connector structure for a flexible light strip (10), comprising:

a cable joint (110) including a housing (120) and a plurality of conductive terminals (130) assembled in the housing (120), each of the conductive terminals (130) including at least one piercing portion (150); and an insulation body (200) including a first end (210) and a second end (220) communicating with the first end (210), the flexible light strip (10) being inserted into the first end (210), and the housing (120) being inserted into the second end (220), wherein the at least one piercing portion (150) is parallel to the flexible light strip (10) and correspondingly pierces the flexible light strip (10) to be electrically coupled to the flexible light strip (10), wherein each of the conductive terminals (130) includes two piercing portions (150), two planar portions (152) and two positioning portions (154), each of the planar portions (152) is disposed at one side of each of the piercing portions (150), and each of the positioning portions (154) is disposed at the other side of each of the piercing portions (150).

12. The connector structure for the flexible light strip of claim 11, wherein the insulation body (200) further includes a concaved portions (250) having a stop portion (260), and the stop portion (260) is provided to position each of the positioning portions (154) or to make contact with the flexible light strip (10).

13. The connector structure for the flexible light strip of claim 1, wherein an outer side surface of the insulation body (200) includes a plurality of protrusions (270), and each of the protrusions (270) is disposed close to the second end (220).

14. A connector structure for a flexible light strip (10), comprising:

a cable joint (110) including a housing (120) and a plurality of conductive terminals (130) assembled in the housing (120), each of the conductive terminals (130) including at least one piercing portion (150); and an insulation body (200) including a first end (210) and a second end (220) communicating with the first end (210), the flexible light strip (10) being inserted into the first end (210), and the housing (120) being inserted into the second end (220), wherein the at least one piercing portion (150) is parallel to the flexible light strip (10) and correspondingly pierces the flexible light strip (10) to be electrically coupled to the flexible light strip (10), wherein the flexible light strip (10) includes a conductive pad (30), and each of the conductive terminals (130) is inserted into the flexible light strip (10) along a direction perpendicular to the conductive pad (30) disposed on the flexible light strip (10).

* * * * *